US005505646A

United States Patent [19]

Poldervaart et al.

[11] Patent Number: 5,505,646

[45] Date of Patent: Apr. 9, 1996

[54] FLOATING UNIT-BUOYANT BODY ASSEMBLY

[75] Inventors: Leendert Poldervaart, Turbie; Sipke T. Schuurmans, Eze, both of France

[73] Assignee: Single Buoy Moorings Incorporated, Marly, Switzerland

[21] Appl. No.: 290,502

[22] Filed: Aug. 15, 1994

[51] Int. Cl.[6] ..... B63B 22/04

[52] U.S. Cl. ..... 441/3; 441/4

[58] Field of Search ..... 441/3–5; 114/230, 114/293

[56] References Cited

U.S. PATENT DOCUMENTS 4,254,522 3/1981 van Heijst ..... 441/3

4,279,047 7/1981 van Heijst ..... 441/5

4,784,079 11/1988 Poldervaart ..... 114/230

*Primary Examiner*—Sherman Basinger

*Attorney, Agent, or Firm*—Young & Thompson

[57] ABSTRACT

A mooring buoy comprising a body with buoyancy, which body is rotatable with respect to a turntable. Elements are provided for connecting the buoy to catenary anchor lines with a seabed as well as a rigid arm for the connection to a vessel or the like floating unit. The buoyant body is an assembly of spaced apart interconnected vertical columns, resulting in a decreased sensibility for vertical motions of waves.

2 Claims, 2 Drawing Sheets

FLOATING UNIT-BUOYANT BODY ASSEMBLY

The invention relates to the combination of a floating unit, such as a vessel, and a spaced apart mooring buoy which have to be connected to each other. The vessel must be able to weathervane around the mooring buoy and to this end a mooring buoy comprises two parts being rotatable relative to each other. The device is particularly suited not to be affected by the action of waves thereon to minimize the loads exerted on the catenary anchor lines connecting the mooring buoy to the seabed and the hinge interconnecting the floating unit and the mooring buoy.

BACKGROUND OF THE INVENTION

To connect floating units, such as vessels, to a mooring buoy several proposals are known from the prior art.

U.S. Pat. Nos. 3,823,432 and 3,908,212 both disclose a single point mooring buoy having a buoyant body which is small with respect to the floating unit, and around which the floating unit can weathervane. The vessel and buoy are interconnected by a rigid arm. This arm has a horizontally disposed hinge interconnecting the floating unit and the buoyant body so that they can achieve an angular displacement at need with respect to each other in a vertical commonplane of symmetry. The size and thereby the mass of the buoyant body is chosen so that it offers very little resistance to the action of waves thereon. Vividly the mooring buoy will follow the motions of the floating unit as well as the motions of the sea surface. The amplitude and frequency of the primarily cyclic motions of the floating unit and the sea surface differ substantially from one another. Such different motions may result in heavy loads exerted on the catenary anchor lines as well as the hinge mentioned above.

The above mentioned known arrangements of a small buoy which by means of a rigid arm is held by the vessel like a barrow does already reduce the loads under the majority of circumstances. However, it may occur that the combination of forces on one hand of the vessel through arm and buoy on part of the catenary lines, in particular if already drifted away from its proper location, and on the other hand of the waves leads to unexpected overloads. These loads appear to be that heavy that the maximum allowable tensions in the catenary anchor lines and in the hinge will be exceeded easily causing line failure and breaking of the pivot respectively.

Moreover, structures of both buoyant body and interconnection means may not the best for use in ice-infested waters. The body of the buoy may strike ice floes during said movements causing even more heavy loads to be exerted on the catenary anchor lines and the hinge.

Alternatively, large semi-submersible mooring buoys are known, for instance from U.S. Pat. No. 4,784,079. Such large structures are particularly indifferent to the motions of the sea surface because of their size being relatively large in view of the amplitude of the waves. These structures are indifferent also to the motions of a vessel interconnected thereto because of their size and mass which may be equal to or even larger than those of said vessel. In U.S. Pat. No. 4,784,079 a rather complex structure for interconnecting the buoyant body and the vessel is shown, primarily to cope with the motions of the floating unit relative to the buoyant body. To this end the connecting means are designed to act like a spring.

The object of the invention is to minimize the loads exerted on both the catenary anchor lines and the hinge caused by the motions of the sea surface and the floating unit relative to the buoyant body.

SUMMARY OF THE INVENTION

According to one aspect of the invention the mooring buoy comprises a body with buoyancy, which body is rotatable with respect to a turntable, means being provided for connecting the buoy to catenary anchor lines as well as a rigid arm for the connection to a vessel or the like floating unit, wherein the buoyant body is an assembly of spaced apart interconnected vertical columns.

The turntable can be arranged below the lower part which interconnects the columns and has means For the connection of anchor lines thereto and has a rigid arm rigidly connecting the body with a pivot to the vessel.

It is also possible that the turntable is arranged at the top of the body and has means for the connection to the vessel, such as a rigid arm which at least at the vessel end has a pivotal connection to the vessel, and wherein the lower part of the body has been provided with the means for the connection of the anchor lines thereto.

The present invention forms an improvement of the above described prior art of e.g. U.S. Pat. Nos. 3,823,432 and 3,908,212 by changing the small buoy with rigid arm between vessel and catenary lines into a plurality of vertical columns although the use of a plurality of columns which intersect the water line is known for large artificial structures such as drilling islands one could not expect that reduction of the water line section at a vessel held buoy could solve the problem of anchor line failure.

It is surprising as well that the assembly of several columns is less affected by ice Floes. There of course is no difference in case of floating icebergs.

BRIEF DESCRIPTION OF THE DRAWINGS

The invention will be further elucidated referring to two embodiments of the invention shown in the drawings, wherein.

DETAILED DESCRIPTION OF THE INVENTION

Figure 1:
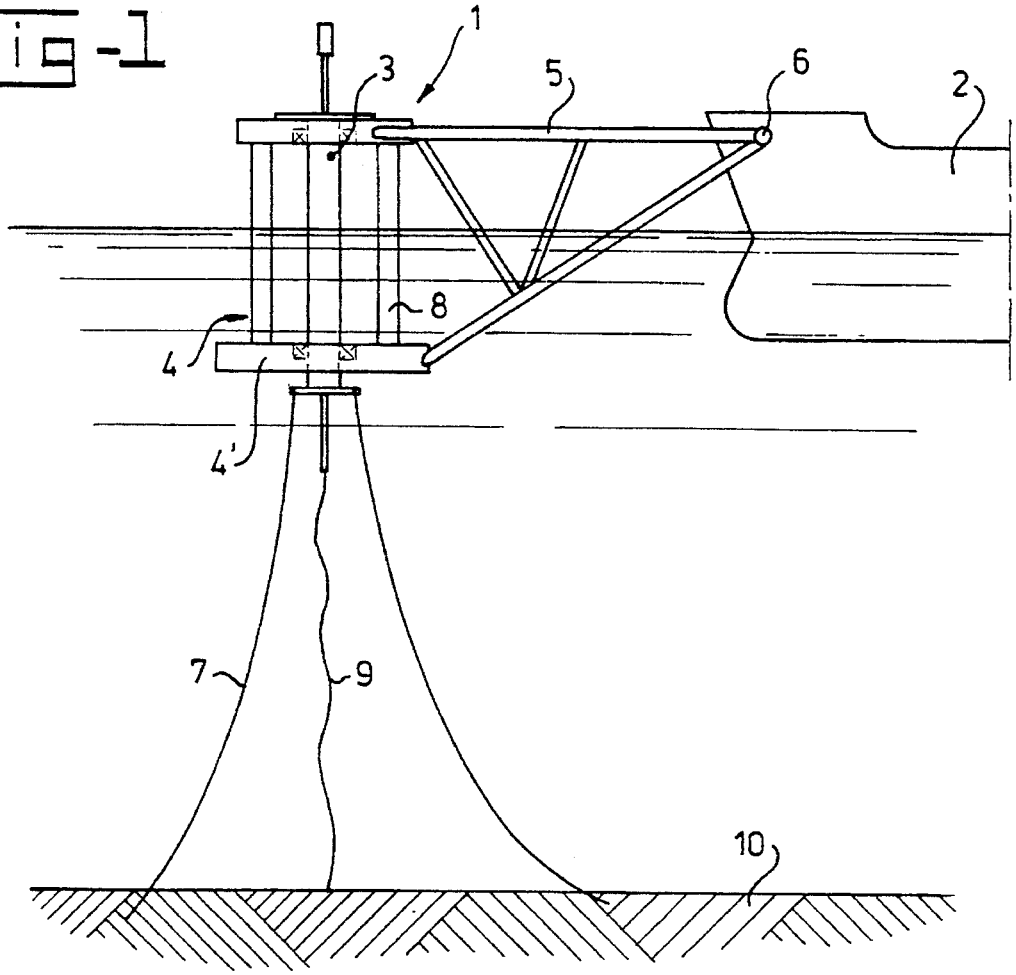
FIG. 1 shows a first embodiment of the invention in side view.
Figure 2:
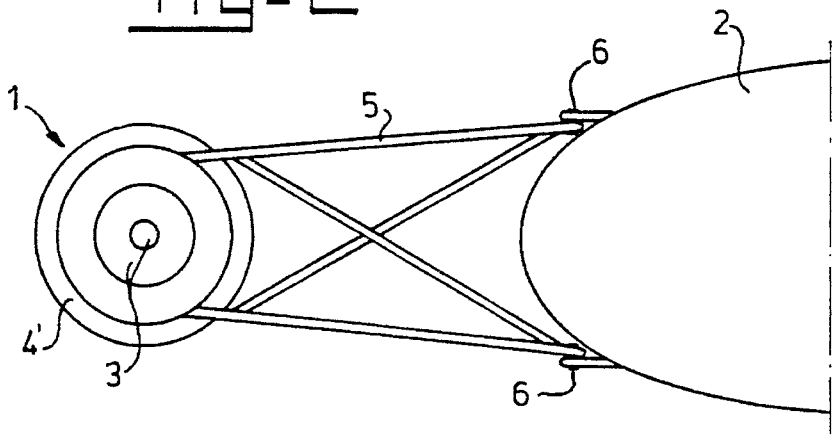
FIG. 2 shows the embodiment according to FIG. 1 in plan view.

In FIGS. 1 and 2 a mooring buoy is shown comprising a buoyant body 1 and a connection arm 5 connecting the buoyant body 1 to a floating unit, such as a vessel 2. Buoyant body 1 comprises an inner part 3 and an outer part 4 which are rotatable with respect to each other. Inner part 3 acts like a turntable. Outer part 4 is rigidly connected to connection arm 5 which is on the other hand connected to vessel 2 through pivot 6. Outer part 4 comprises several spaced apart vertical columns 8, which are arranged in a circular array. Inner part 3 is provided at its lower end with a lower part 4' interconnecting the columns 8. The lower part is provided with connection means for catenary anchor lines 7 which are connected to the seabed 10. Through inner part 3 a conduit 9 extends. It will be understood that instead of one conduit 9 several conduits or other devices could be provided. Through a swivel arrangement communication is provided with a conduit (not shown) in arm 5, said conduit ending in vessel 2.

Figure 3:
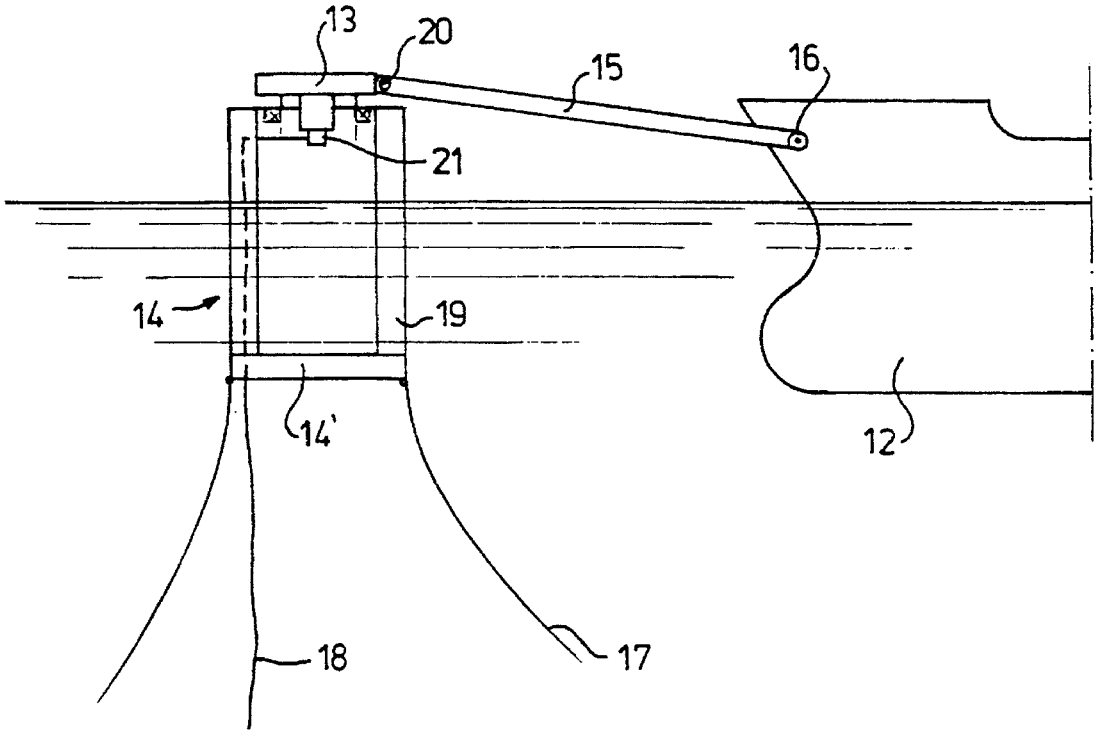
FIG. 3 shows a further embodiment of the invention.

In the embodiment according to FIG. 3 the buoyant body has reference number 19. In this case the inner part, i.e. turntable, 13 can be either swivelly connected through pivot 20 or rigidly connected to connection arm 15. Connection arm 15 is connected to vessel 12 through a pivot 16. Inner part 13 is rotatable with regard to outer part 14 of buoyant body 19. Outer part 14 is provided with a lower part 14' interconnecting the columns 19. The lower part is provided with catenary anchor lines 17 which are connected to the seabed. Conduit 18 extends From this outer part 14 to the seabed. Through a swivel arrangement 21 outer part 14 and inner part 13 are connected and a conduit (not shown) extends from the inner part 13 through the connection arm 15 to vessel 12.

With the structure according to FIG. 3 the buoyant body 19 will remain vertical longer irrespective of the position of vessel 12. This is not true for the embodiment of FIGS. 1 and 2 wherein a vertical displacement and an alternating height of vessel 2 will put the mooring buoy out of line relative to a vertical axis. However, this effect is relatively small if a considerable length of the connection arm 5 is used. The structure shown in FIG. 3 does not present such a disadvantage and is of particular interest in relatively harsh environmental conditions. Dynamic loads in the anchor lines 17 and the pivots 16, 20 are reduced through the semi-submersible embodiment of the buoyant body 19. Especially, the spaced apart vertical columns 19 (like the columns 8 in FIGS. 1 and 2) having a diameter very much smaller than the diameter of the buoyant body 19, i.e. the connecting ends at the upper and lower end of the columns 19, make the buoyant body 19 essentially indifferent to the relative motions of the sea surface and the Floating unit 12.

Although the embodiment according to FIGS. 1 and 2 is most preferred at the time being from the embodiment of FIG. 3 it will be immediately clear that a lot of amendments can be introduced without leaving the scope of protection. These and other amendments which are obvious For the persons skilled in the art do not restrict the scope of protection of the application.

We claim:

1. Mooring buoy comprising a buoyant body which is movable in a vertical direction under the influence of waves, said body being rotatable with respect to a turntable, means for connecting the mooring buoy to catenary anchor lines, said anchor lines being the sole means for anchoring the mooring buoy to the seabed, and means for directly connecting the mooring buoy to a pivot point on an end of a floating vessel via a rigid arm whereby the rigid arm is the only connection between the pivot point and the buoy, said buoyant body comprising an assembly of spaced apart interconnected vertical columns, whereby said buoyant body is flexible in heave and essentially indifferent to relative motions of the floating vessel and sea surface.

2. Mooring buoy according to claim 1, wherein the turntable is located at the top of the buoyant body and includes said means for directly connecting to said pivot point via the rigid arm, said buoyant body having a lower part interconnecting the columns, and said lower part including the means for connecting to the catenary anchor lines.

* * * * *